US005356346A

United States Patent [19]

Katje et al.

[11] Patent Number: 5,356,346

[45] Date of Patent: Oct. 18, 1994

[54] PINSETTER MASKING UNIT

[75] Inventors: Michael J. Katje, Spring Lake; William C. Murphy, Fremont; Michael F. Stirling, Spring Lake, all of Mich.

[73] Assignee: Brunswick Bowling & Billiards Corporation, Muskegon, Mich.

[21] Appl. No.: 2,913

[22] Filed: Jan. 11, 1993

[51] Int. Cl.[5] ..... A63D 5/04

[52] U.S. Cl. ..... 473/54; 49/360; 181/295

[58] Field of Search ..... 49/360, 361, 362; 40/601, 611; 52/473, 483, 144, 145; 181/30, 295; 273/37, 54 R, 54 C; 16/DIG. 1

[56] References Cited

U.S. PATENT DOCUMENTS

| | | | |
|---|---|---|---|
| 2,485,397 | 10/1949 | Anderson et al. | 273/54 R |
| 3,018,105 | 1/1962 | Grogoza | 273/54 R |
| 3,436,863 | 4/1969 | Peelle, Jr. et al. | 49/362 |
| 3,541,731 | 11/1970 | Rossie | 49/360 |
| 3,738,656 | 6/1973 | Lazar et al. | 273/54 R |
| 3,908,787 | 9/1975 | Wenger et al. | 181/30 |
| 4,188,752 | 2/1980 | Monot | 49/362 X |
| 4,339,129 | 7/1982 | Gautraud | 273/54 R |
| 4,977,704 | 12/1990 | Koenig | 49/362 |
| 5,040,332 | 8/1991 | Aquilina | 49/361 |
| 5,087,041 | 2/1992 | Gagnon | 273/54 R |
| 5,176,582 | 1/1993 | Chang et al. | 49/360 X |

*Primary Examiner*—Vincent Millin
*Assistant Examiner*—William M. Pierce
*Attorney, Agent, or Firm*—Wood, Phillips, VanSanten, Hoffman & Ertel

[57] ABSTRACT

A masking unit for bowling lanes equipped with automatic pinsetters, comprising a vertically moving masking panel and a series of stepped panels in front of the moving panel and extending from the top thereof to the ceiling of the bowling establishment. Stanchions at each end of a panel hold wheeled carriages which engage tracks on the back of the moving panel so that the panel may be vertically raised and lowered. Chain driven control means assures that one end of the panel does not get ahead of the other when the panel is being moved, and spring biasing means aid in raising the panel.

19 Claims, 5 Drawing Sheets

PINSETTER MASKING UNIT

FIELD OF THE INVENTION

This invention is in the field of bowling, principally ten pin bowling and relates to the capitol equipment required for operation of a modern multi-lane bowling establishment equipped to service bowling league play in which the participants bowl alternately upon a pair of lanes that are associated for score keeping purposes. Specifically, the invention is a vertically movable free standing unit set in front of the automatic pinsetters for the purpose of hiding or masking the pinsetters from the view of the bowlers, and a series of stepped vertical panels forward thereof to fill the space between the top of the masking unit and the ceiling of the establishment.

BACKGROUND OF THE INVENTION

In bowling establishments it is common practice to hide the automatic pinsetters from the view of the bowler with a vertical panel having an artistic design thereon, the lower edge of which is positioned approximately two feet above bowling lane. Such panels are commonly referred to as masking units, a name which generally applies not only to the masking panel itself but also to the structure which supports the panel.

The masking panels are typically positioned close to the front edge of the pin deck and therefore close to the front of the pinsetter. So positioned, they block access to equipment containing microprocessors and other electronic controls which are now frequently mounted to the front of the pinsetters. Therefore, some means of moving the panel to provide access to the front of the pinsetter installation is highly desirable. In the past, an attempt to provide such access was to mount the panel so that it could be rotated to a horizontal position by lifting the front of the panel, as disclosed in U.S. Pat. No. 4,339,129 assigned to Brunswick Corporation. However, this structure did not provide clear access to the front of the pinsetter. The present invention is directed to overcoming this and other problems associated with masking units of past designs.

SUMMARY OF THE INVENTION

An improved masking unit is provided including means for vertically moving the pinsetter masking panel between a lowered position where it hides the pinsetter from the view of the bowler and a raised position which clears the area in front of the pinsetter.

Support for the masking unit of the invention is provided by a plurality of stanchions anchored to the lane foundation. The masking panels are attached to these stanchions at each end by a plurality of sliding or carriage elements which ride within tracks. A rotating control member prevents one end of a panel from moving up or down faster than the other and thus keeps the assembly aligned at all times. A tensioned coil spring associated with said control member may be used to counter the weight of the vertically moving assembly of the masking unit. The structure permits easy removal of the masking panel itself to facilitate changing the same.

Structure for supporting a series of stepped vertical panels in front of the masking unit may be added by attaching the same to the stanchions. The panels, spaced periodically and at successively higher levels above and in front of the masking unit may be used to decorate the area between the top of the masking unit when in the lowered position and the ceiling of the bowling establishment.

DETAILED DESCRIPTION OF THE PREFERRED EMBODIMENT

Figure 1:
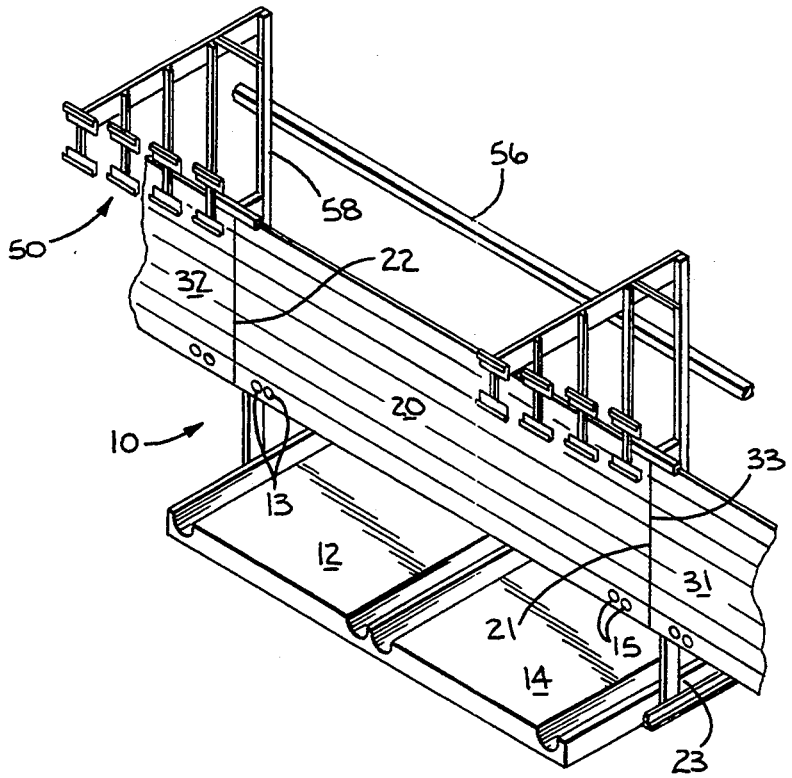
FIG. 1 is a perspective front view from above and to the right of a masking unit and supports for the upper stepped panel assembly of the invention.

Referring to FIG. 1, a masking unit 10 of the invention is illustrated as installed in its operating position across the end of a pair of companion bowling lanes 12 and 14 respectively. Typically, the lane pair share a common ball return (not shown) that runs between and beneath the two lanes. Since it is common for bowlers on opposing teams to switch lanes between frames, the two lanes are treated as a unit in many ways, one of which is that they share a common masking panel 20 which bears a design that generally extends between the right end 21 and the left end 22 of the panel 20. First and second ball lights 13 and 15 for lanes 12 and 14 are mounted to a bottom support element 25 for the masking panel 20.

Each masking panel 20 is supported at ends 21 and 22 by stanchions 23 and 24, respectively, in a manner disclosed below. Since a bowling establishment typically includes many pairs of lanes, adjacent masking panels such as 31 and 32 to the right and left, respectively, of panel 20 will share stanchions 23 and 24 with masking unit 20, as will be apparent from the following description of the supporting mechanisms.

FIG. 1 also illustrates an upper stepped panel assembly 50 including a series of vertical panels 51–54 (see FIG. 2) and means for supporting each panel in front, above and vertically overlapping the one behind. The purpose of these panels is to cover the area between the top of masking panel 20 and the ceiling and at the same time provide a sense of depth and provide means for adding a pleasing artistic touch to the decor of the establishment. The entire assembly of the masking unit 10 and the vertical panel assembly 50 is steadied by a lateral brace 56 that extends across the back and is attached to each vertical support 58 of the panel structure 50.

Figure 2:
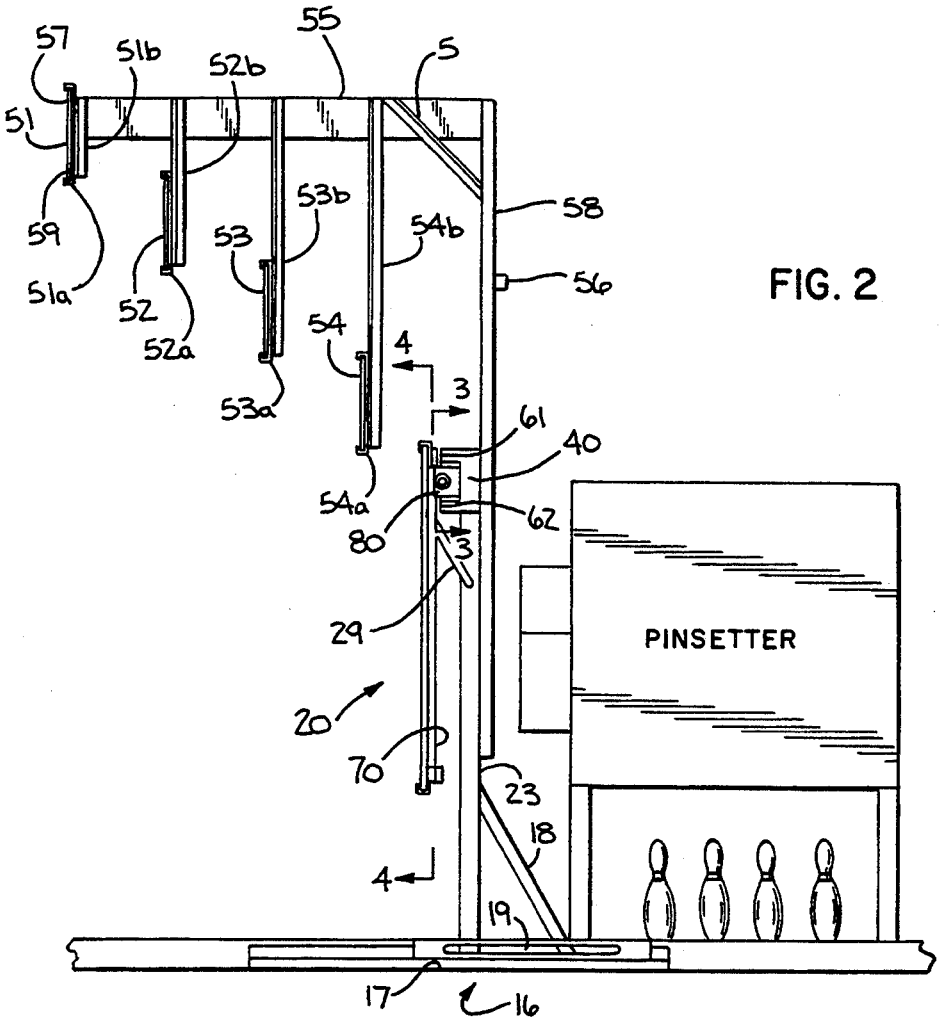
FIG. 2 is a right side view of a masking unit and stepped panel assembly of FIG. 1 showing the invention positioned upon a bowling lane and illustrating the relative position of an associated pinsetter and pins upon the lane.

Referring to FIG. 2, the vertical support 23 is anchored to the foundation 16 of its associated bowling lane 14 by a metal horizontal base 17 which is attached by conventional means to a longitudinal stringer of the lane foundation 16. The vertical support 23 is typically bolted to the base member 17. A brace 18 is attached to the base member 17 and angles up to the vertical support 23. Slots 19 in the base member 17 permit fore and aft positioning of the vertical support 23 and brace 18.

A bracket 40 (best illustrated in FIG. 5) is attached to the top of the vertical support member 23. Wheeled carriages 60 attached to bracket 40 engage a track 70 attached to the panel 20 so that the panel 20 may be raised and lowered as described below. The track 70 is sized to accept and trap the carriages 60 therein in a closely fitting relationship, so that the panel 20 will glide smoothly up and down.

A rotatable arm 29 is attached to support 23 approximately one foot below the bracket 40. This arm engages the bottom support 25 for the panel 20 or the track 70 when the panel is in the raised position. Its function is to prop the panel 20 in the raised position.

The stepped panel assembly 50 includes a horizontal top support member 55 which extends forwardly of the vertical support 58 and the panel 20 and is attached to and supported by the vertical support 58. The panels 51–54 are each held in position by frames **51*a*–54*a*, each of which has an upper inverted U-shaped channel 57 and a lower U-shaped channel 59 sized to accept its respective panel. The upper channel 57 is deep enough to permit the upper edge of a panel to be placed therein and the panel lifted up over the front edge of and the lower channel 59 and then lowered thereinto for retention without coming out of the upper channel 57. The panel may be taken out of the frame by lifting up and moving the lower edge forward of the frame. The frames 51*a*–54*a* are attached to and held in place by vertical members 51*b*–54*b* which are attached to the horizontal top support member 55 by conventional means. The members 51*b*–54*b* vary in length so as to position the panels 51–54 in stepped overlapping arrangement, as viewed from the head of the lane, between the top of the panel 20 when in the down position and the ceiling (not shown). The entire panel assembly 50 remains clear of the area above the vertically moving panel 20 so that the panel 20** may be raised to the full extent permitted by the support mechanism.

Figure 3:
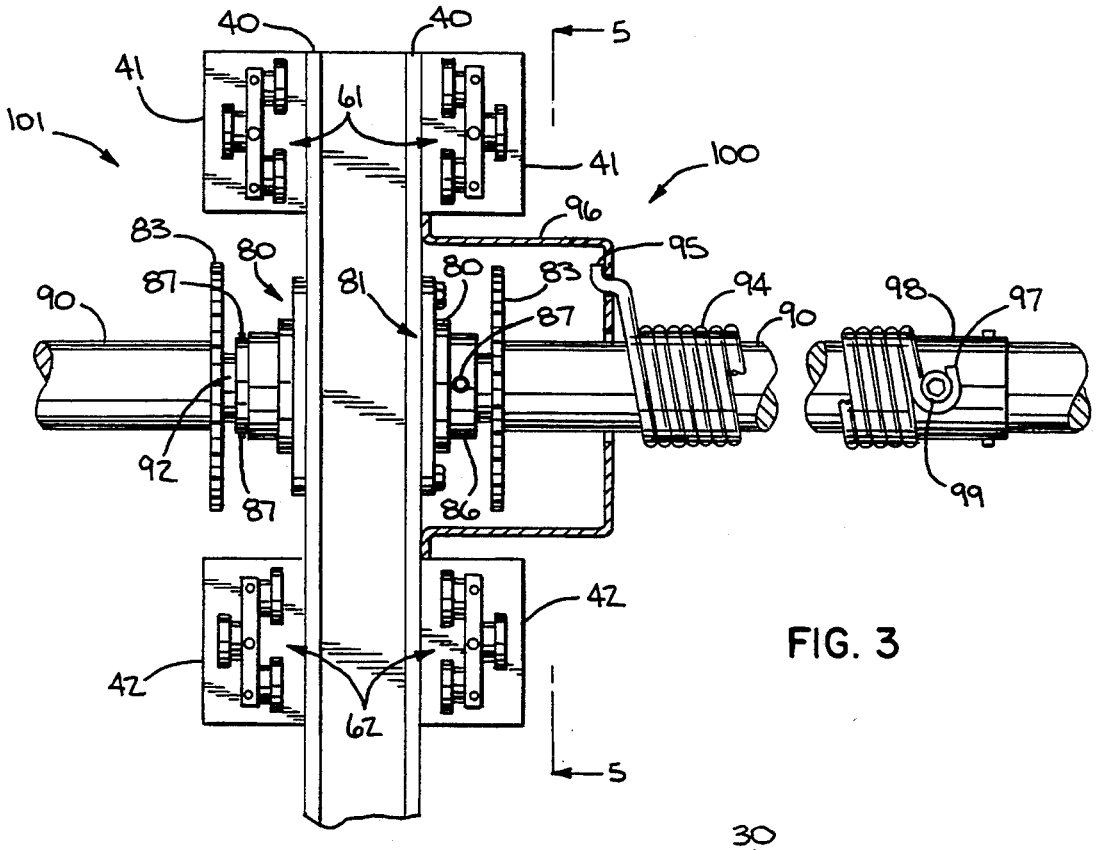
FIG. 3 is a view of adjacent moving masking panel support mechanisms of the invention taken along line 3—3 of FIG. 2.

FIG. 3 is a front view of stanchion 23 and the various elements of the invention attached thereto that support adjacent masking panels 20 and 31 for vertical movement. The assembly 100 attached to the right side of stanchion 23 interacts with the track 70 on the left end 33 of the masking panel 31 and the assembly 101 attached to the left side of stanchion 23 interacts with the track 70 on the right end 21 of a masking panel 20, as explained below. As the panels 20, 31 and 32 are mechanically identical, FIG. 3 is representative of the mechanisms that support the opposite ends of each one, i.e. assembly 100 supports the left end of each panel and assembly 101 supports the right end of each panel. (Note: The directions "left" and "right" used in this specification are as seen from the head of the bowling lanes.)

Figure 5:
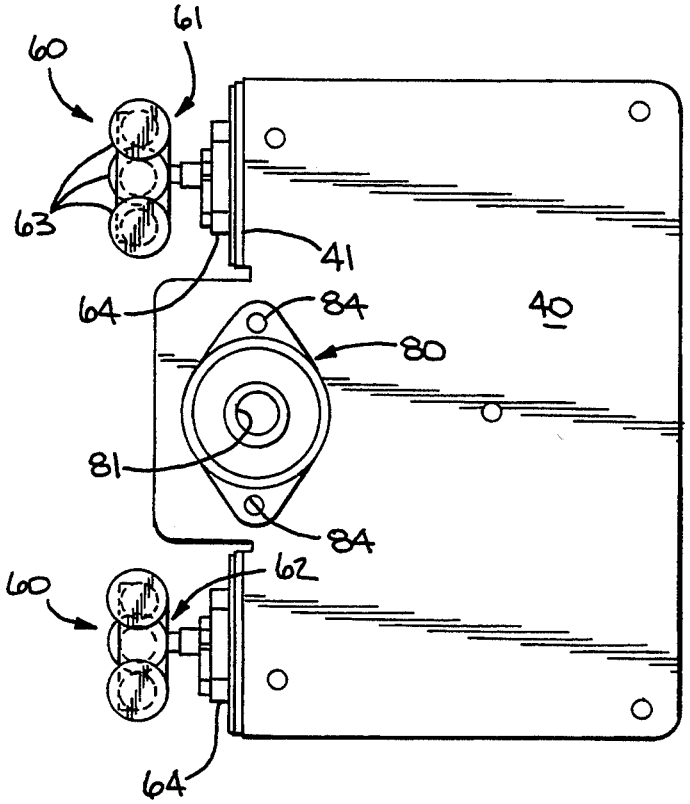
FIG. 5 is a side view of a stationary portion of a support mechanism for a moving masking panel taken along line 5—5 of FIG. 3 of the invention.

Referring to FIGS. 3 and 5, the right assembly 100 includes a mounting bracket 40 which is bolted to stanchion 23 and has upper and lower tabs 41 and 42, respectively, which extend outwardly at 90 degrees from the stanchion 23. Upper and lower wheeled carriages 61 and 62, respectively, are bolted to the front faces of tabs 41 and 42. A flange bearing assembly 80 is bolted to bracket 40 between the carriages 61 and 62. The bearing 80 supports a plain bearing 81 within which rides a shaft 91 which is attached to the left end of a tube 90. The tube 90 is a rigid tube that extends between adjacent stanchions such as 23 and 24. Its left end is illustrated in assembly 100 and its right end in assembly 101. A shaft 92 attached to the right end of tube 90 rides within a plain bearing 82 held by a bearing retainer 80 attached to a bracket 40 on the left side of stanchion 23.

An identical sprocket wheel 83 is fixedly attached to each of the shafts 91 and 92, which are in turn fixedly attached to their respective ends of the tube 90, so that the tube 90 and sprocket wheels 83 rotate in unison. The sprocket wheels 83 engage chains 75 attached to each end of the panels as explained below, so that one end does not move up or down faster than the other and alignment of assembly is maintained. Locking collars 86 and associated set screws 87 serve to axially position the shafts 91 and 92 and their attached sprocket wheels 83 in alignment with their associated chains 75 on the back of the panel 20.

The tube 90 may have a torque applied thereto to aid in lifting its associated panel 20. For this purpose a coil spring 94 is disposed around the tube 90. The end of the spring 95 adjacent to stanchion 23 engages a bracket 96 bolted to bracket 40 in a manner that enables the spring 94 to be torqued about the tube 90. The other end 97 of spring 94 is locked to the tube 90 after torquing by a collar 98 which receives the internal end 97 of the spring 94 and is in turn pinned to the tube by locking pins 99. Once the panel 20 is engaged with the sprocket wheels 83, the spring 94 may be torqued to the desired degree.

Figure 4:
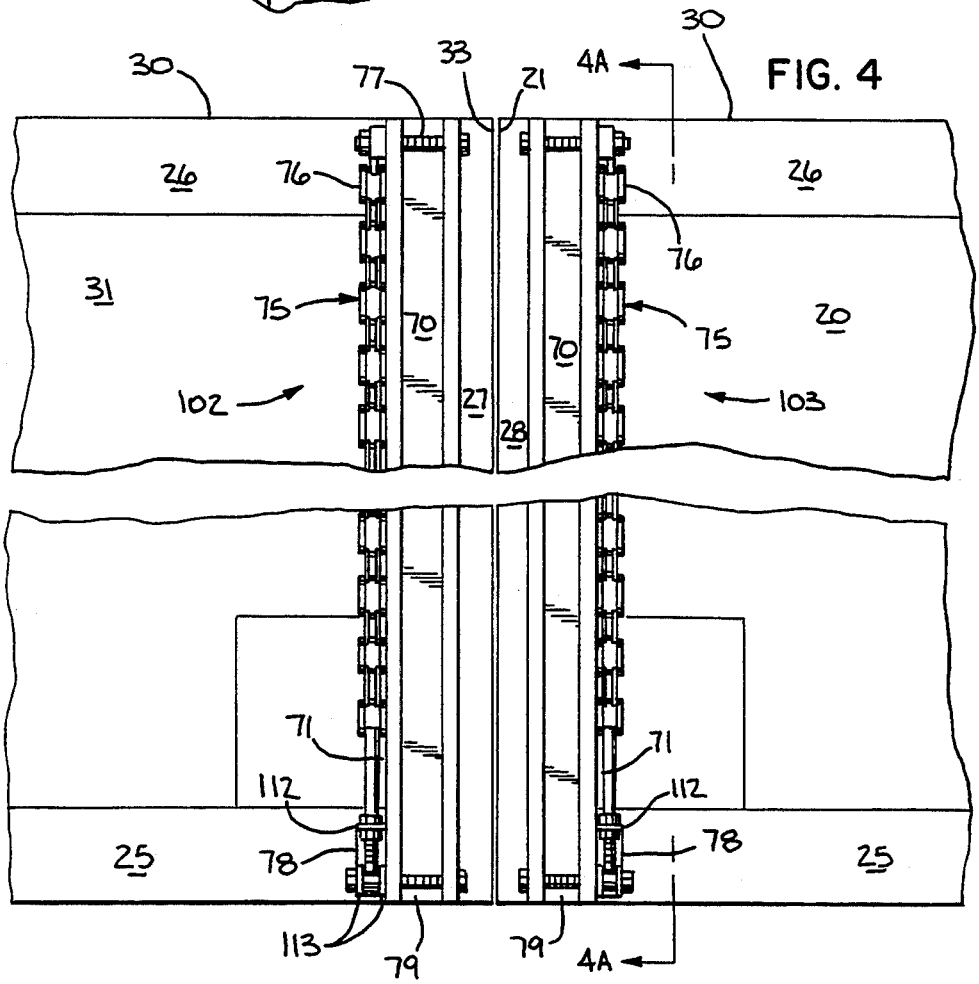
FIG. 4 is a view of the end portions of adjacent moving masking panels of the invention taken along line 4—4 of FIG. 2.

FIG. 4 illustrates the track and chain assemblies 102 and 103 attached to the back of masking panels 20 and 31, and which interact with assemblies 100 and 101, respectively, of FIG. 3. The right-hand side of each panel 20, 30 or 31 has a track and chain assembly identical to 103 and the left-hand side has a track and chain assembly identical to 102.

Each of the moving masking panels 20, 31 and 32 is mounted on a rectangular metal frame 30 comprised of the bottom 25, a top 26, a left side member 27 and a right side member 28.

Each of the side members 27 and 28 of the frame 30 has a track 70 attached by the back thereof extending from top to bottom of the frame. A motion control chain 75 is positioned adjacent to the inside edge 71 of each track 70. The upper end of the chain 75 is attached to the track 70 by an upper chain anchor 76. A bolt 77 passes through the upper anchor 76 and the upper end of the track 70. A connecting link of chain connects the chain to the anchor.

Figure 4A:
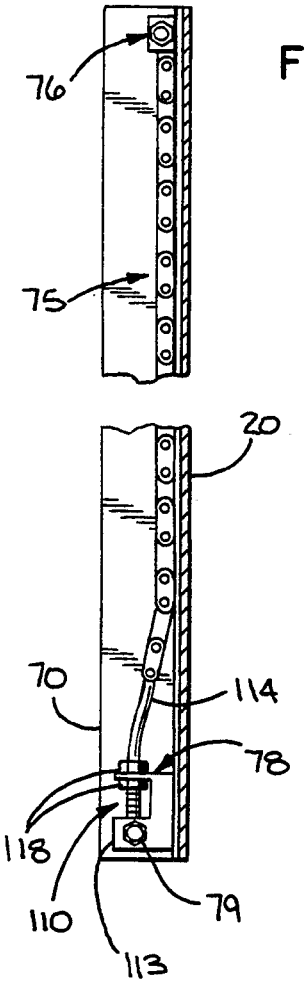
FIG. 4A is an end view of the right-hand moving masking panel of FIG. 4 taken along line **4*a*—4*a*** thereof.
Figure 7:
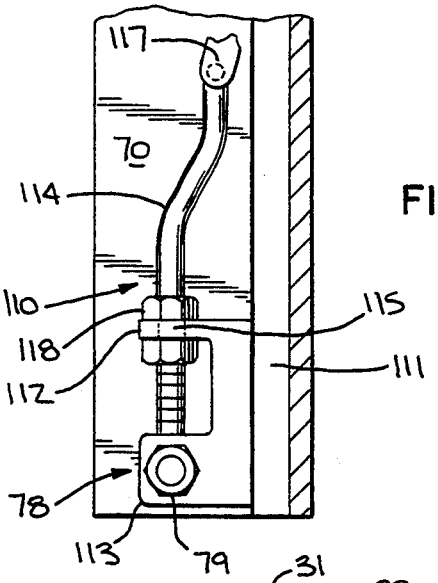
FIG. 7 is a side view of a lower adjustable chain anchor fitting of the invention.

Referring to FIGS. 4, 4A and 7, the lower end of the chain 75 is attached to the side of the track 70 by means of an adjustable anchor mechanism 110 which includes an elongated base 111, an up-turned end 112 and up-turned side ears 113. A threaded chain attaching finger 114 passes through a hole 115 in the upturned end 112 of the anchor 110 and is retained in the desired position by lock nuts 118 threaded thereon in opposite sides of the upturned portion 112 of the anchor 110. The outer end 116 of the finger 114 has a bore 117 therethrough sized to accept a linking pin of the chain 75. By adjustment of the nuts 118, tension on the chain may be adjusted. It is desirable to keep the chain taught to maintain positive contact between the chain 75 and the sprocket wheel 83. The finger 114 has a moderate "S" curve therein so as to hold the chain close to its supporting side frame member 26 or 27. The lower chain anchor 78 is attached to the track 70 by a bolt 79 which passes through the ears 113 and the lower end of the track 70. The attaching bolts 77 and 79 prevent the track 70 from sliding off of the carriages 60.

Figure 6:
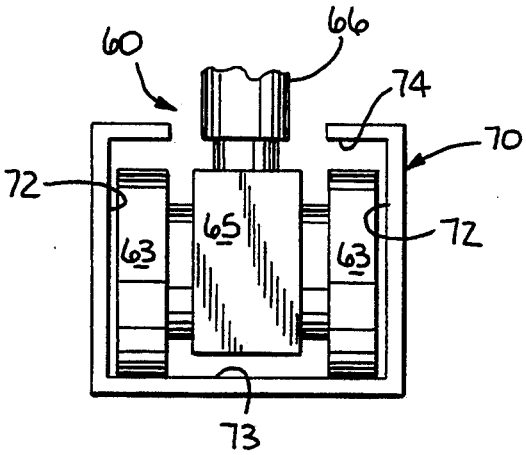
FIG. 6 is a cross-sectional view of a track of the invention with a carriage of the invention positioned therein.

Referring to FIGS. 5 and 6, each carriage 60 has a body 65 to which the wheels 63 are attached in a manner known to the art. The body 65 is attached to the carriage base 64 by an arm 66 which is securely attached to the base 64. The base 64 is bolted to one of the tabs 41 or 42 of the bracket 40. Carriages suitable for this purpose are those used in sliding door assemblies and may be purchased over the counter. For example, L. E. Johnson Products, Inc., 2100 Sterling Avenue, Elkhart, Ind. is a manufacturer and sells carriages suitable for this purpose and specified in their literature as a hanger No. 1020. The track 70 is also manufactured by this company and is designated by Part No. 111-0048, particularly for use with their Part No. 1020.

The flange bearing assembly 80 is attached to the bracket 40 and is positioned so that when the shaft 91 is assembled therein, the sprocket wheel 83 will engage the chain 75 on the back of the panel 20. A plane bearing 81 is held by the bearing housing 80 in a conventional manner and the housing 80 is attached to the bracket 40 by bolts 84.

Referring to FIG. 6, the track 70 is an extruded aluminum piece having a cross-sectional shape configured to accept through an open end and support therein the carriages 60. The clearance between sides of the wheels 63 of the carriage 60 and the inside side walls 72 of the track, and the clearance between the wheels 63 and the inside front 73 and back 74 of the track 70 should be sufficient to permit easy movement of the carriage within the track, yet maintain the alignment of the attached chain 75 with sprocket wheel 83. This clearance permits the wheels 63 to engage either the front 73 or the back 74 of the track 70 and thus rotate without binding when the masking panel 20 is raised or lowered.

Upon assembly of a moving panel 20 to its supporting elements, its track and chain assemblies 102 and 103 illustrated in FIG. 4, will engage with carriage and sprocket assemblies such as 100 and 101, respectively, illustrated in FIG. 3. An upper 61 and a lower 62 carriage will be engaged within a track 70 and the spokes of the sprocket wheel 83 will be aligned with and engaged upon the chain 75 positioned adjacent the track 70. Once assembled, the chain retaining bolts 77 and 79 prevent the panel 20 from sliding free of the carriage 61 or 62.

Figure 9:
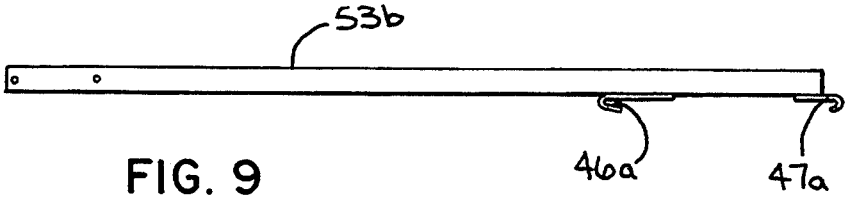
FIG. 9 is a plan view of a support arm for a panel of the upper stepped panel assembly of the invention.
Figure 9A:
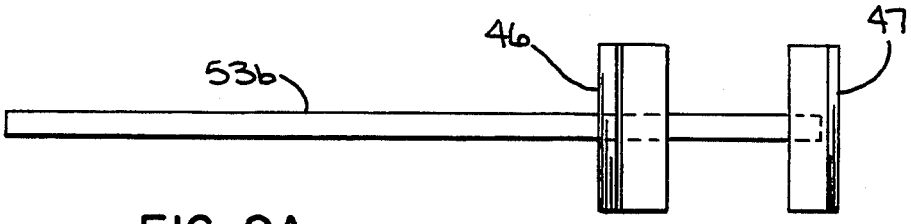
Figure 10:
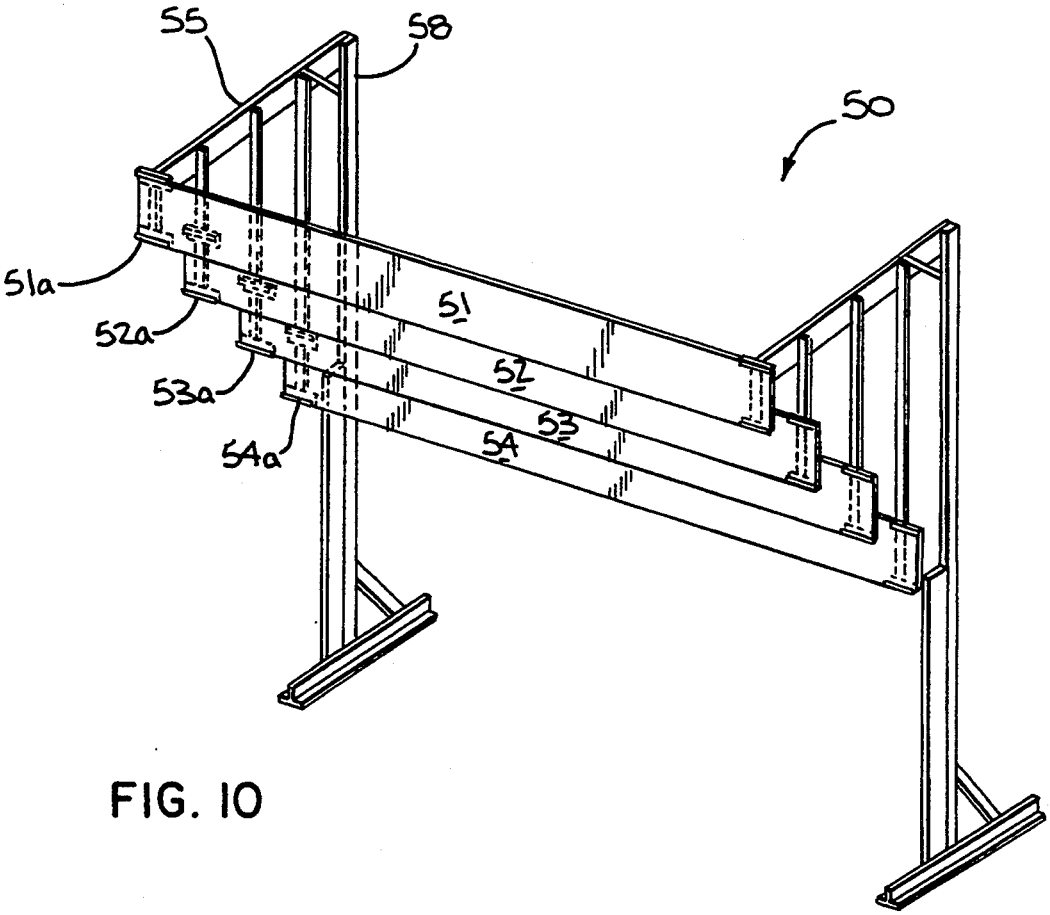
FIG. 10 is a perspective view of the upper stepped panel assembly of the invention taken from forward and to the right of its associated lane pair.

FIGS. 9 and **9*a* illustrates the support assembly for vertical panels 52 shown in FIGS. 1, 2 and 10, and is representative of each of the supports for the panels 51–54**.

The support has an arm **53*b* which may be attached to the horizontal support member 55 by any conventional means. Attached at the lower end of arm 53*b*, are top horizontal member 46 and a bottom horizontal member 47, each extending approximately 8 to 10 inches on either side of the arm 53*b*. The bottom horizontal member 47 has its lower edge turned up to form a channel 47*a* therealong having a depth of approximately ½ inch. The top horizontal member 46 has its upper edge turned down to form a channel 46*a*** therealong having a depth of 1 inch.

On such support is provided for each end of the panels 51–54. The deeper upper channel **46*a* permits the panel to be inserted therein and lifted high enough to permit the lower edge of the panel to clear the upper lip of the channel 47*a*. When lowered into channel 47*a*, the panel 53 must be high enough so that its top edge remains within channel 46*a*. The panel 53** may be removed by reversing the insertion process.

The horizontal support members 55 and attached support arms **51*b*–54*b* for the stepped panel array 50 are located between each lane pair, and the frame elements 46 and 47 suspended therefrom extend to each side of the horizontal support member 55, so as to provide support for the ends of two adjacent vertical panels extending to opposite sides of the support arm 55** and across adjacent lane pairs.

FIG. 10 illustrates the vertical stepped panel assembly 50 of the invention with the panels 51–54 installed within their supporting frames **51*a*–54*a*. Each of the panels overlaps the one behind sufficiently to prevent the top edge of the panel behind from being visible to a bowler standing at the head of the lane or seated in the bowler seating provided. This arrangement reduces the amount of panel material required to a minimum. At the outer sides of the first and last lanes, the frame elements 46 and 47 of the frames 51*a*–54*a*** may be removed or adjusted in length to hold a panel extending to the nearby wall, or otherwise adjusted to accommodate a partial panel length.

It is contemplated that panels 51–54 will be decorated to provide a pleasing effect and to enhance the sense of depth provided by the assembly 50.

Figure 8:
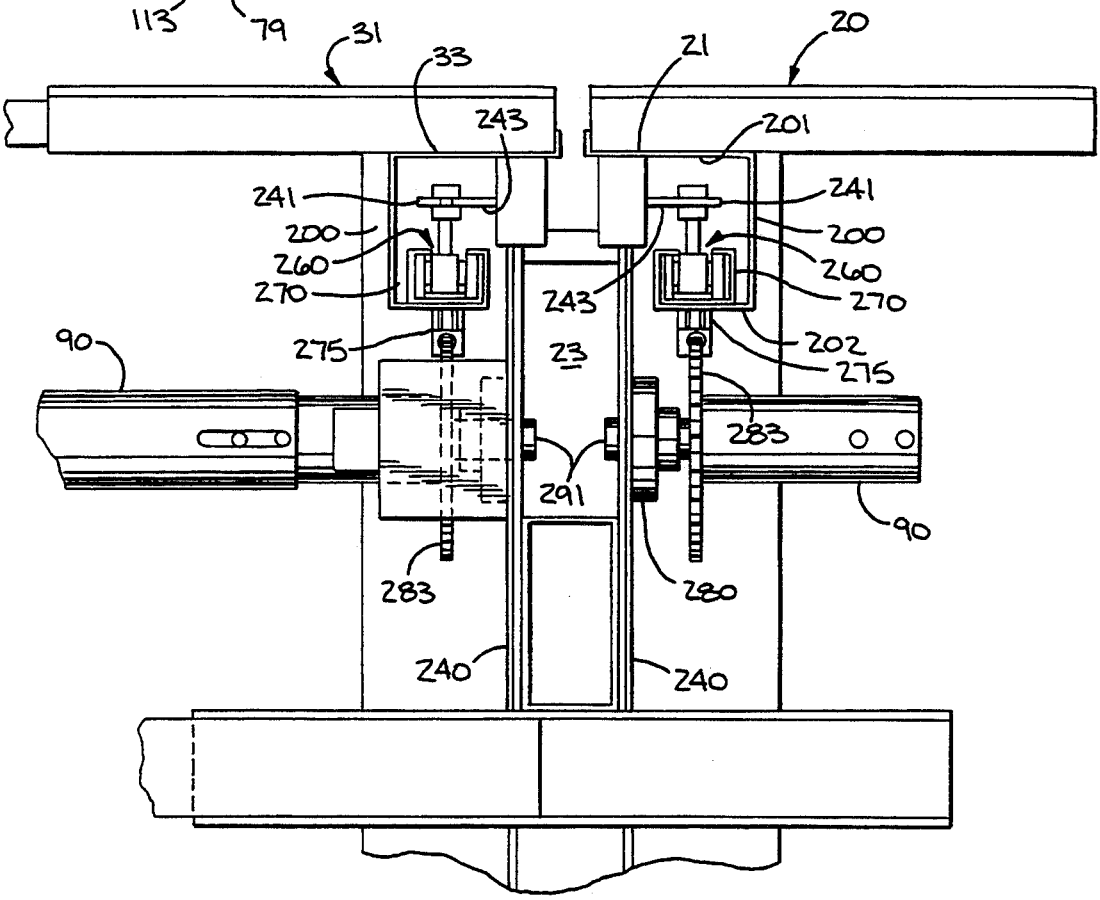
FIG. 8 is a top view of an alternate embodiment of the invention showing a stanchion and attached support mechanism for adjacent moving masking panels.

FIG. 8 illustrates an embodiment of the invention which has not yet been built and tested but is believed to be the best embodiment of the invention envisioned to date. In this embodiment, the carnages 260 are attached to the back faces 243 of the wings 241 of the bracket 240 and so extend aft therefrom toward the sprocket wheel 283. The tracks 270 are attached to the vertical side frame members 28 and 27 of the masking panels 20 and 31 respectively by U-shaped brackets 200 which are attached to and extend the length of their respective side arms 28 and 27 of their frames 30.

The U-shaped bracket 200 is oriented so that it opens to the outer edge of the panel 20. The forward arm 201 of the U-shaped bracket 200 is attached to the side frame member 21, while the track 270 is attached to the inside of the back arm 202 of the bracket 200. The track 270 is laterally positioned on the arm 202 so as to engage the carriages 261 and a companion lower carriage (not shown) as described above.

A chain 275 is attached to the back side of the arm 202, with its longitudinal axis parallel to and in fore-and-aft alignment with the longitudinal axis of the track 270. Upper and lower chain anchors are attached to the back arm 202 of the U-shaped bracket 200 and the chain 275 is tensioned between these two anchors.

Sprocket wheels 283 and attached shafts 291, similar in function to wheel 83 and shaft 91 described above, are positioned within flange bearings 280 so that the sprocket wheels 283 and their teeth maintain pressure contact with the chain 275. The extent of the said pressure may be adjusted by changing the tension of the chain, as earlier described.

The remainder of the support assembly, e.g. the connecting tube 90, spring 94 and spring anchor brackets 96 and 98, remain essentially the same as illustrated in FIGS. 3–5 and described above. The principal advantage of this embodiment of the invention is that the controlling action of the chain and sprocket wheel assembly is more positive, due primarily to the fore and aft alignment of each track, its attached chain 75 and sprocket wheel assembly.

It will be understood that the invention may be embodied in other specific forms without departing from the spirit or central characteristics thereof. The present examples and embodiments, therefor, are to be considered as illustrative and not restrictive, and the invention is not to be limited to the details given herein.

We claim:

1. A device for hiding bowling pinsetters on bowling lanes from the view of the bowlers, comprising:

an opaque masking panel, means for supporting said panel above and across a plurality of bowling lanes in a plurality of vertical positions, comprising two vertical stanchions positioned one adjacent each end of the masking panel, a linear track member mounted on the back and adjacent to each end of the masking panel, a plurality of wheeled carriage members positioned upon each vertical stanchion and engaged for linear motion upon one of said tracks and means for retaining said carriage members in engagement with said tracks, means for attaching the plurality of carriage members to each of said vertical stanchions, means apart from the track and carriage members for synchronizing the vertical movement of the opposite ends of the masking panel, comprising:

a plurality of sprocket wheels, means for rotatingly attaching a sprocket wheel to each of said vertical stanchions, chain means positioned adjacent to and parallel to each of said tracks for positively engaging the sprocket wheels, and means for interconnecting said sprocket wheels so that they rotate in unison, so that the chain means and the ends of the masking panel more vertically in unison as the connected sprocket wheels rotate.

2. The device of claim 1 wherein said masking panel is comprised:

a rigid rectangular frame, a removable rectangular panel sized to fit within said frame, means for retaining said removable panel within said frame, and wherein said tracks are attached to said frame.

3. The device of claim 1, wherein the longitudinal axis of said linear means for positive engagement with the sprocket wheel and the longitudinal axis of the track member adjacent to said linear means lie in a common vertical plane perpendicular to the masking panel.

4. The device of claim 1 wherein said track members are generally rectangular and have a slot extending linearly thereof adapted to accept passage of the means for attaching the wheeled carriage members to the stanchions.

5. The device of claim 4 wherein the slot in the track faces away from the back of the masking panel.

6. The device of claim 1 further including means for exerting upward bias upon said masking panel to help raise the same.

7. The device of claim 1 further comprising:

an elongate U-shaped bracket positioned adjacent to each end of the panel, one leg of the U-shaped bracket attached to the panel so that the U opens toward the end of the panel, and wherein the track members are attached to the inside of the other leg of the U-shaped brackets, and the chain means are attached to the outside of the other leg of the U-shaped bracket and parallel to the track members.

8. The device of claim 7 wherein the longitudinal axis of the chain means is in fore-and-aft alignment with the longitudinal axis of its associated track member.

9. The device of claim 7 wherein the slot in the track faces the back of the masking panel.

10. The device of claim 8 further comprising means for adjusting the tension of the chain means and thereby the pressure exerted by the chain means upon the sprocket wheel.

11. The device of claim 8 wherein the longitudinal axis of each wheeled carriage member is in fore-and-aft alignment with the longitudinal axis of the track member upon which it is engaged.

12. A vertically moving rectangular pinsetter masking panel comprising:

a pair of vertical supports mounted upon adjacent bowling lanes, one support at each end of the panel, a planar rectangular panel extending between the vertical supports and means for supporting the panel for movement between raised and lowered positions, comprising a plurality of wheeled carriages attached to each vertical support;

vertical track means attached to each back end edge of the moving panel for engagement with the wheeled carriages;

means for synchronizing the vertical movement of the ends of the masking panel comprising a sprocket wheel rotationally attached to each vertical support;

chain means for posivitively engaging said sprocket wheels affixed adjacent and parallel to each track; and means for connecting the sprocket wheels so that they rotate in unison, whereby the ends of the masking panel are caused to move vertically at the same rate to avoid jamming, and wherein said vertical supports, attached wheeled carriages and sprocket wheels and means for connecting the sprocket wheels extend no higher above the bowling lanes than the top of the masking panel when in the lowered position.

13. A device for hiding the pinsetters on an adjacent pair of bowling lanes from the view of the bowlers, comprising:

a rectangular planar masking panel extending across two adjacent bowling lanes and means for supporting the panel for vertical movement comprising a vertical support at each end of the panel;

mechanisms for movably supporting the masking panel mounted adjacent to the upper end of each vertical support comprising two vertically aligned wheeled carriage members, a sprocket wheel positioned between the carriage members, and means for mounting the sprocket wheel for rotation in a plane perpendicular to the plane of the masking panel;

track means for engaging the wheeled carriage members affixed to the back of the masking panel at each end thereof and extending substantially from the top edge to the bottom edge of the masking panel;

chain means for engaging the sprocket wheel positioned adjacent and parallel to each of the track members, said chain means being positively engaged by the teeth of the sprocket wheel; and means for connecting the sprocket wheels so that they rotate in unison.

14. In a bowling establishment having a plurality of bowling lanes equipped with automatic pinsetters and a plurality of masking units disposed across said lanes in front of said pinsetters, a device for masking an area above and behind the said masking units from the view of bowlers, comprising:

a plurality of elongated vertical panels disposed across at least one bowling lane, means for supporting said panels in generally parallel array in spaced apart positions in front of and overlapping the masking unit with the bottom of each panel overlapping the panel next behind and the top of each panel being at least as high above the bowling lanes as the panel next behind.

15. The device of claim 14 wherein said means for supporting said panels comprises:

a plurality of vertical support elements and means for supporting said vertical support elements in fixed positions upon said bowling lanes;

a plurality of horizontally extending support elements attached to and extending forwardly of said vertical support elements; and means for attaching said panels to said horizontal support elements.

16. A device for masking an area above the movable pinsetter masking panels positioned upon a plurality of bowling lanes, comprising:

an array of a plurality of elongated vertical panels;

means for supporting said array in front of and above said masking panels and across a plurality of bowling lanes, said array overlapping said masking panels with each vertical panel in front of the panel behind;

said supporting means comprising, at least two vertical stanchions and means for anchoring said stanchions between the bowling lanes;

a plurality of horizontally extending support members attached to and extending forwardly of said vertical stanchions; and a plurality of vertical support members attached to and extending downwardly from said horizontal support members and means for attaching the vertical panels to said vertical support members, said vertical support members being axially spaced along said horizontal members.

17. The device of claim 16 wherein said means for attaching said vertical panels to said vertical support means comprise:

a lower U-shaped channel configured to accept the lower edge of a vertical panel; and an upper inverted U-shaped channel member configured to accept the upper edge of a vertical panel, and greater in depth than said lower channel.

18. In a bowling establishment having a plurality of bowling lanes equipped with automatic pinsetters and a plurality of masking units disposed across said lanes in front of said pinsetters, a device for masking an area above and behind the said masking units from the view of bowlers, comprising:

a plurality of elongated vertical panels disposed across at least one bowling lane;

means for supporting said panels in generally parallel array in spaced apart positions in front of the masking unit with the bottom of each panel overlapping the panel next behind and the top of each panel being at least as high above the bowling lanes as the panel next behind;

a plurality of vertical support elements and means for supporting said vertical support elements in fixed positions upon said bowling lanes;

wherein said means for supporting said panel comprises:

a plurality of horizontal extending support elements attached to and extending forwardly of said vertical support elements; and means for attaching said panels to said horizontal support elements.

19. A plurality of vertically moving bowling pinsetter masking panels linearly arrayed across a plurality of adjacent bowling lanes in front of the pinsetters wherein each panel is positioned across two adjacent pairs of bowling lanes, comprising:

a plurality of masking panels arranged end-to-end and means for supporting said panels for vertical movement above the bowling lanes, comprising:

a single vertical stanchion positioned between each pair of bowling lanes, means for slidingly attaching adjacent ends of adjacent masking panels to the single vertical stanchion comprising, a vertical track member attached to the back of each panel at each end thereof and a wheeled carriage assembly comprised of a plurality of wheeled carriages attached to each side of the vertical stanchion, each carriage assembly being engaged upon a track member, and means for retaining said carriage members engaged upon said track members, whereby a single vertical stanchion slidingly supports the adjacent ends of two adjacent masking panels disposed across adjacent pairs of bowling lanes.

* * * * *